US006729619B2

(12) United States Patent
Yu et al.

(10) Patent No.: US 6,729,619 B2
(45) Date of Patent: May 4, 2004

(54) DICE GAME

(75) Inventors: Brian Yu, Hawthorne, CA (US); Jonathan Bedford, Hawthorne, CA (US)

(73) Assignee: Mattel, Inc., El Segundo, CA (US)

( * ) Notice: Subject to any disclaimer, the term of this patent is extended or adjusted under 35 U.S.C. 154(b) by 0 days.

(21) Appl. No.: 10/286,356

(22) Filed: Oct. 31, 2002

(65) Prior Publication Data

US 2003/0085515 A1 May 8, 2003

Related U.S. Application Data

(60) Provisional application No. 60/350,144, filed on Nov. 2, 2001.

(51) Int. Cl.[7] ..... A63F 9/04

(52) U.S. Cl. ..... 273/146; 273/274; 273/309

(58) Field of Search ..... 273/146, 236, 273/138.1

(56) References Cited

U.S. PATENT DOCUMENTS

| | | | | | |
|---|---|---|---|---|---|
| 2,528,029 | A | | 10/1950 | Brown | |
| D209,297 | S | | 11/1967 | Hulser | |
| 3,734,501 | A | | 5/1973 | La Monica | |
| 3,826,498 | A | | 7/1974 | Monek | |
| D262,725 | S | | 1/1982 | Rice | |
| 4,350,339 | A | * | 9/1982 | Imbert | 273/148 A |
| 4,480,838 | A | * | 11/1984 | Aharonian | 273/256 |
| 4,678,191 | A | * | 7/1987 | Mills et al. | 273/146 |
| 4,708,344 | A | | 11/1987 | Wyatt | |
| 4,852,878 | A | * | 8/1989 | Merrill | 273/156 |
| 4,921,251 | A | | 5/1990 | Kanenwisher | |
| 5,046,743 | A | | 9/1991 | Salerno | |
| 5,234,218 | A | | 8/1993 | LaRocca | |
| 5,265,881 | A | * | 11/1993 | Doherty | 273/274 |
| 5,372,366 | A | * | 12/1994 | Gohlke | 273/274 |
| D383,799 | S | | 9/1997 | Beaumier et al. | |
| D389,874 | S | | 1/1998 | Kazangian | |
| 5,779,239 | A | * | 7/1998 | Lind | 273/260 |
| 5,791,651 | A | * | 8/1998 | Bryant | 273/274 |
| 5,857,676 | A | * | 1/1999 | Whitson | 273/292 |
| 5,879,006 | A | * | 3/1999 | Bowling | 273/274 |
| 5,961,119 | A | * | 10/1999 | Brown | 273/292 |
| 6,047,967 | A | | 4/2000 | Murphy et al. | |
| 6,068,259 | A | | 5/2000 | Dolin | |
| 6,176,489 | B1 | * | 1/2001 | Astaneha | 273/274 |
| 6,193,233 | B1 | | 2/2001 | Lipman | |
| 6,299,166 | B1 | | 10/2001 | Factor | |
| 6,302,395 | B1 | * | 10/2001 | Astaneha | 273/274 |
| 6,305,686 | B1 | * | 10/2001 | Perrie et al. | 273/146 |
| 6,336,633 | B1 | * | 1/2002 | Webb | 273/274 |
| 6,481,713 | B2 | * | 11/2002 | Perrie et al. | 273/146 |
| 6,508,469 | B2 | * | 1/2003 | Promutico | 273/274 |
| 6,565,088 | B2 | * | 5/2003 | Perrie et al. | 273/146 |
| 6,596,351 | B1 | * | 7/2003 | Thompson | 428/7 |
| 6,601,848 | B1 | * | 8/2003 | Timmons, Sr. | 273/146 |
| 6,605,001 | B1 | * | 8/2003 | Tarantino | 463/22 |
| 2002/0109298 | A1 | * | 8/2002 | Zaruba et al. | 273/292 |

* cited by examiner

*Primary Examiner*—Benjamin H. Layno
*Assistant Examiner*—Dolores R. Collins
(74) *Attorney, Agent, or Firm*—Kolisch Hartwell, P.C.

(57) ABSTRACT

A dice game including dice, chips, predictive markers, and methods of play. The goal of the game is to be the first person to obtain all the chips from the other players. Chips are used for wagering on the outcome of dice rolls. The game may optionally employ predictive markers to facilitate predictions for the outcome of the dice roll.

14 Claims, 4 Drawing Sheets

DICE GAME

CROSS-REFERENCE TO RELATED APPLICATIONS

This application claims priority under 35 U.S.C. §119(e) to U.S. Provisional Patent Application No. 60/350,144 entitled "Dice Game," filed Nov. 2, 2001, the disclosure of which is herein incorporated by reference.

BACKGROUND OF THE INVENTION

Dice games for multiple players have been in use for many years and are well known in the art of gaming. Dice games are commonly used in both gambling and non-gambling gaming applications. Gambling versions of dice games commonly incorporate one of two types of gaming competition and, consequently, of betting arrangement. Players may either compete individually against a house or against other players. Accordingly, the dividend of a player's wager, when successful, is typically either backed by a house or by a collective pot of players' money. In either arrangement, gambling dice games often revolve around predictive guessing, such as betting on the value of the next roll in Craps.

In contrast, non-gambling dice games often incorporate point-based or goal-oriented competition. In point-based games, the object is typically to possess either the greatest or the least number of points at the end of the game. In goal-oriented games, a player may win by accomplishing some dice-related task, such as rolling a particular consecutive series of dice combinations. Additionally, it is not uncommon for dice games to use combinations of both styles of competition, such as those which reward points for the accomplishment of particular goals. However, non-gambling game play tends to be reactionary, based on the chanced roll of never-changing dice combinations, rather than incorporating the ever-changing predictive element common to many gambling games.

A major source of attraction for gambling dice games often lies in their ability to create a thrilling atmosphere of suspense due to the risks and potential rewards inherent in play. Gambling games typically use either currency or chips during play to reflect players' wagers because the clear representation of their possible gains and losses can heighten the intensity of the gaming experience. Such an atmosphere can be created for groups of players by pool-style gambling where each player's bet is combined in a collective pot, which, in turn, is awarded to the winner. In this respect, non-gambling dice games are commonly inferior to their gambling counterparts. Merely tallying points or completing ordered tasks is often not as effective in inducing the degree of excitement common to wager-style play.

However, whereas gambling dice games may commonly be restricted to inconveniently located gaming establishments, non-gambling dice games may often be played just about anywhere by just about anyone. Non-gambling dice games can provide gaming enjoyment among groups of players for whom participation in gambling may not be desirable, appropriate, or legal. Consequently, non-gambling dice games may be ideal for many groups of players, such as those who wish to compete in table games in a casual household setting.

As a result, there is need in the art for the development of non-gambling dice games for multiple players that are capable of incorporating the varied benefits of traditional gambling and non-gambling gaming applications. For this reason, the development of dice games for multiple players that combine the suspense of pot-style wagering, the variety of predictive guessing, and the convenience of family-style gaming in a single non-gambling embodiment would be very beneficial to the art of gaming.

SUMMARY OF THE INVENTION

The present invention provides methods and components of a dice game. The object of the game is for players to obtain all of their opponents chips by predicting the results of a roll of at least one die.

The advantages of the present invention will be understood more readily after a consideration of the drawings and the Detailed Description of the Preferred Embodiment.

DETAILED DESCRIPTION OF THE PREFERRED EMBODIMENT

The dice game is suitable for a plurality of players 100. In the example shown in FIG. 1, four players 100 are shown, including a player A 102, a player B 104, a player C 106, and a player D 108.

Figure 1:
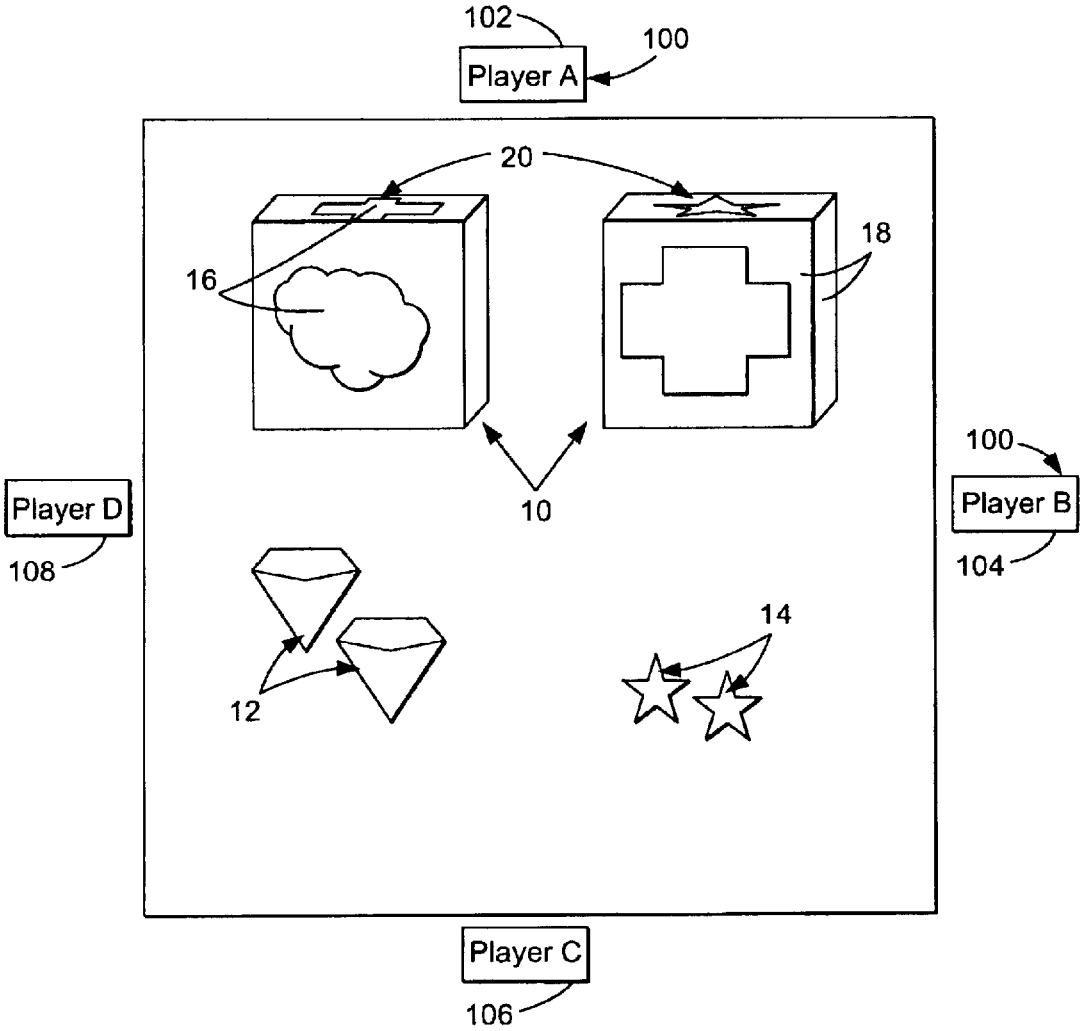
FIG. 1 depicts layout of players and components of a dice game, including dice, chips, and predictive markers.

The components of the dice game include multiple dice 10, chips 12, and predictive markers 14, as shown in FIG. 1. Dice 10 are imprinted with non-numerical indicia 16 on at least one of the several sides 18 of each die 10. The particular dice roll combination of indicia 20 is used to determine play progression.

Figure 2:
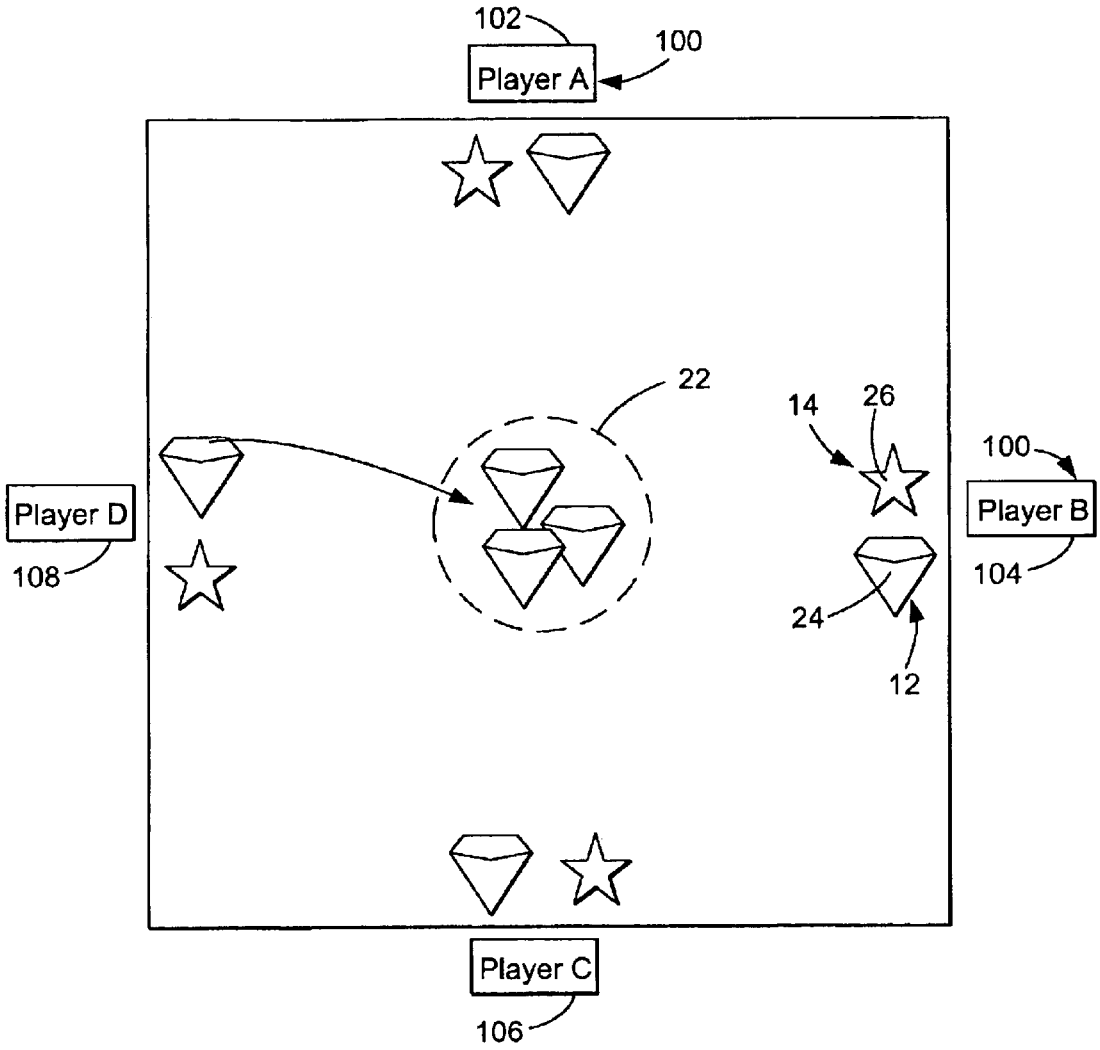
FIG. 2 depicts wagering of players using chips.

Chips 12 are used to place a players' 100 wager into a pot 22, as shown in FIG. 2. In one embodiment of the game, the chips are in the shape of gemstones 24. Predictive markers 14 are typically two-sided and may be in the shape of stars 26.

Figure 3:
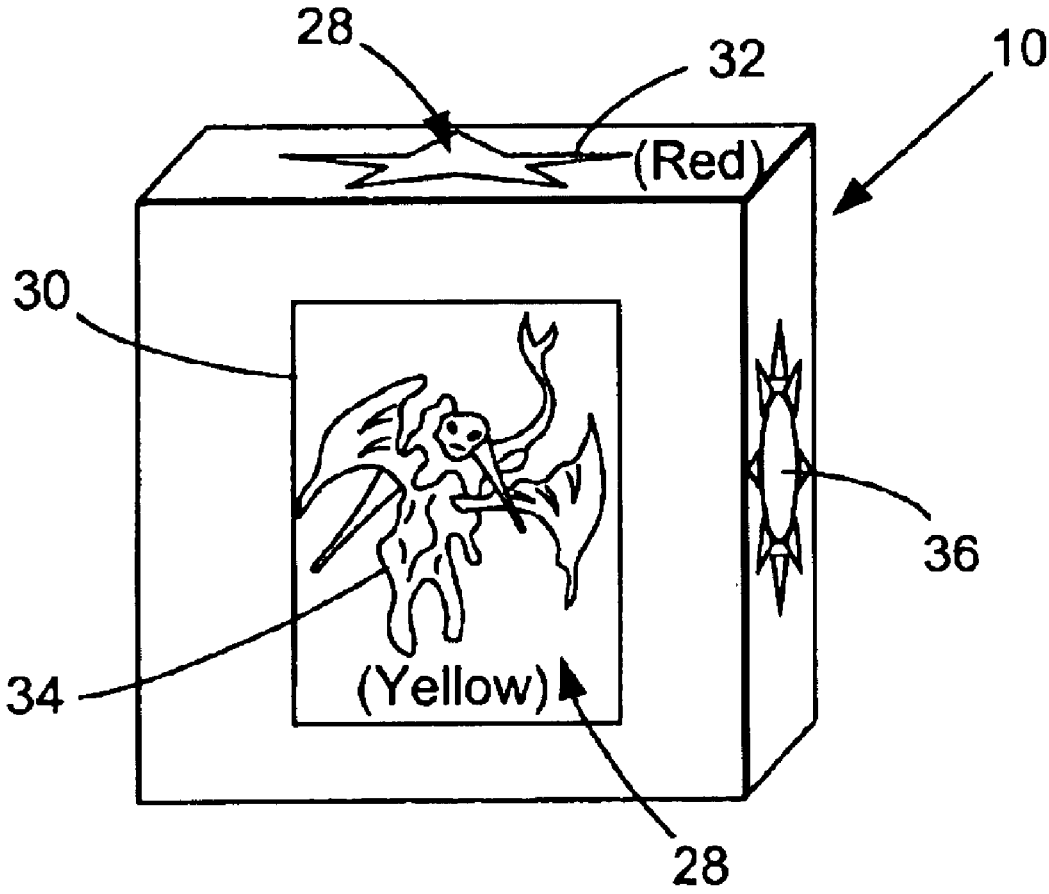
FIG. 3 shows details of a die, including colored character indicia and wild indicia used to distinguish each pattern.

As shown in FIG. 3, dice patterns 28 typically are subdivided into at least a first pattern 30 and a second pattern 32, and usually up to five patterns, with one side 18 remaining blank. These patterns 28 may further include colored character indicia 34, as shown in FIG. 3 by a depiction of a dragon from *Yu-Gi-Oh* by Kazuki Takahashi, and wild indicia 36. Each of the wild indicia 36 is distinct from one another and may be found on only one of the dice 10.

Figure 4:
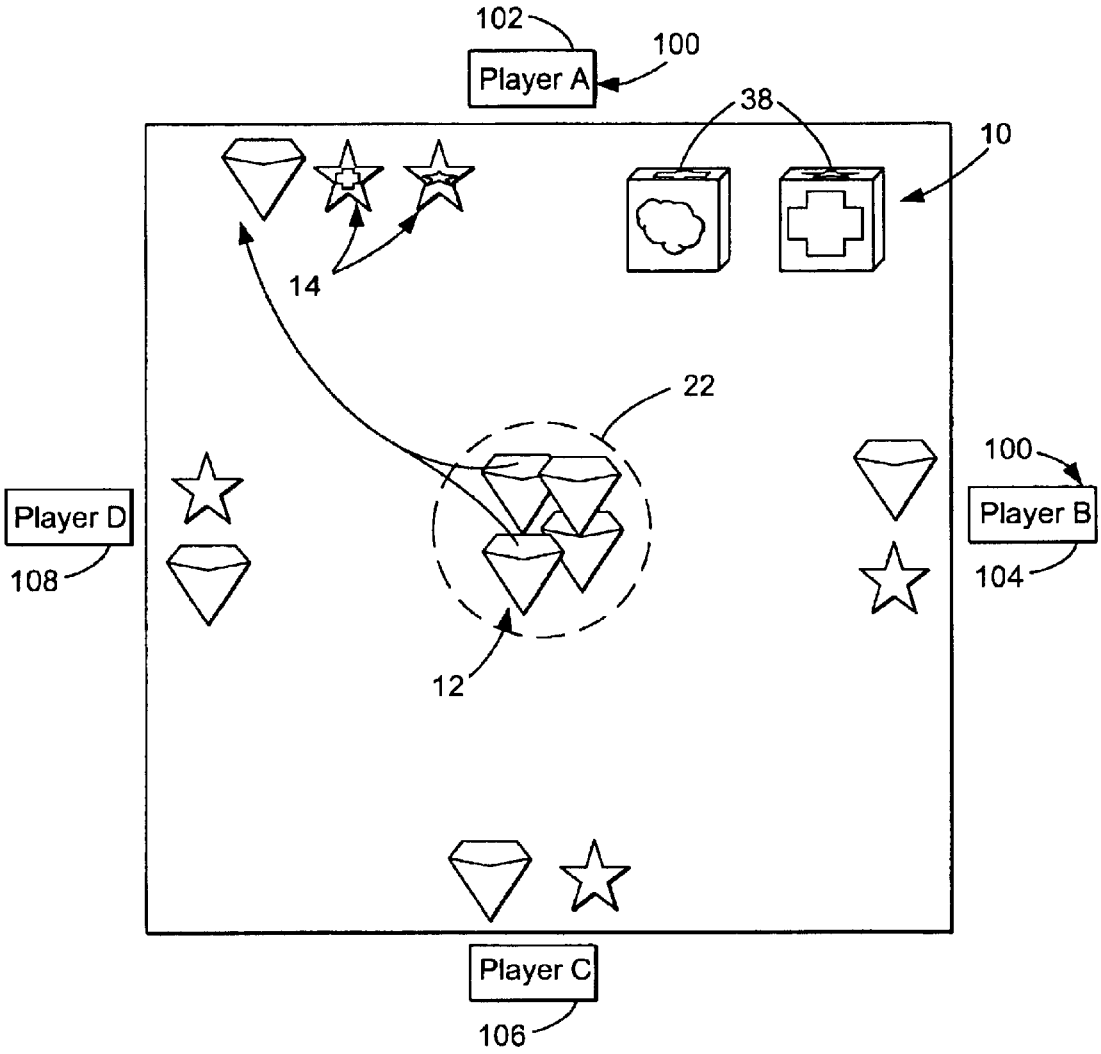
FIG. 4 depicts the awarding of a pot of chips to a player correctly predicting an outcome of a dice roll.

Chips 12 are divided equally among players 100. Players 100 then ante at least one chip 12 into pot 22. A first player, player A 102 in this example, then selects a roll combination that he or she wants to predict will be the result of the roll of dice 10. The first player 102 then rolls dice 10. If player 102 correctly predicted outcome 38 of dice 10, as shown in FIG. 4, then player 102 wins pot 22. If outcome 38 was not correctly predicted by first player 102, then the next player, player B 104 in this example, takes a turn to predict outcome 38 and re-rolls dice 10. In one embodiment of the dice game, predictive markers 14 are used to record a player's predicted outcome 38. The prediction may be recorded by setting forth predictive markers 14 that bear indicia 34 corresponding to that on the dice 10.

In one embodiment of the game, each player 100 may predict outcome 38 of a roll of dice 10 as long as each player

100 selects an outcome 38 different from that selected by other players 100. That way, play will progress more quickly as the odds of a player 100 winning pot 22 increases. If no player 100 correctly predicts the dice roll outcome 38, then players 100 ante additional chips 12 into pot 22 and play proceeds.

If, at any time during play, pattern 30 is rolled such that wild indicia 36 is revealed, pot 22 automatically is awarded to a particular player 100 based on a predetermined meaning of each of the distinct wild indicia 36. For example, rolling of a particular wild indicia 36 may indicate that pot 22 is awarded to player 100 to the left of first player 102.

Play continues until one of players 100 has won all chips 12 from the other players 100.

It is believed that the disclosure set forth above encompasses multiple distinct inventions with independent utility. While each of these inventions has been disclosed in its preferred form, the specific embodiments thereof as disclosed and illustrated herein are not to be considered in a limiting sense as numerous variations are possible. The subject matter of the inventions includes all novel and non-obvious combinations and subcombinations of the various elements, features, functions and/or properties disclosed herein. Similarly, where any claim recites "a" or "a first" element or the equivalent thereof, such claim should be understood to include incorporation of one or more such elements, neither requiring nor excluding two or more such elements.

Inventions embodied in various combinations and subcombinations of features, functions, elements, and/or properties may be claimed through presentation of new claims in a related application. Such new claims, whether they are directed to a different invention or directed to the same invention, whether different, broader, narrower or equal in scope to the original claims, are also regarded as included within the subject matter of the inventions of the present disclosure.

What is claimed is:

1. A dice game for multiple players, comprising:

multiple dice, wherein each die includes non-numerical indicia on several of its sides, not all of the non-numerical indicia included on several sides of each die are all identical to those included on the sides of every other die, and at least one of the several sides of each of the multiple dice is blank, being void of non-numerical indicia;

predictive markers adapted to record a player's prediction; and chips, wherein the chips are anted into a pot that is won by a player as determined by a match between that player's predictive markers and a particular dice roll combination.

2. A dice game for multiple players in accordance with claim 1, wherein the number of the multiple dice is two.

3. A dice game for multiple players in accordance with claim 1, wherein the at least two patterns of the non-numerical indicia are depicted by colored character indicia.

4. A dice game for multiple players in accordance with claim 3, wherein the colored character indicia depict characters based on a cultural phenomenon, including a comic book or cartoon.

5. A dice game for multiple players in accordance with claim 1, wherein the non-numerical indicia included on several sides of each die further comprise at least two distinct wild indicia, each of the wild indicia uniquely referencing a single player.

6. A dice game for multiple players in accordance with claim 5, wherein each of the distinct wild indicia is located on one or more sides of only one of the multiple dice.

7. A dice game for multiple players in accordance with claim 1, wherein the chips are shaped as gemstones.

8. A dice game for multiple players, comprising:

at least one die, wherein each die includes non-numerical indicia on several of its sides; and predictive markers, wherein the predictive markers include non-numerical indicia that correspond to the non-numerical indicia on the at least one die and the predictive markers are two-sided having different non-numerical indicia or colors on either side.

9. A dice game for multiple players in accordance with claim 8, wherein the predictive markers are shaped as stars.

10. A method of playing a dice game by multiple players, comprising the steps of:

providing multiple dice, wherein each die includes non-numerical indicia on several of its sides, and chips;

receiving of an equal number of chips for wagering;

anteing at least one of the chips into a pot to enter a round of play;

predicting the outcome of a dice roll combination of indicia by a first player;

rolling the multiple dice by the first player;

awarding of the chips anted into the pot to the first player if the resulting dice roll combination of indicia matches the first player's prediction;

repeating the prediction and rolling steps, if the resulting dice roll combination of indicia does not match the first player's prediction, each other player having a turn to predict the combination of indicia and roll the multiple dice until the pot is awarded to one of the players or until all of the players have rolled the multiple dice;

re-anteing an additional chip into the pot and repeating the prediction and rolling steps, if all of the players have rolled the multiple dice without the pot having been awarded to a player;

eliminating from further play players having no remaining chips;

wagering and predicting steps being started over if the pot has been awarded to a player, the status of being the first player and the subsequent order of play rotating among the multiple players, until each player but one has been eliminated from further play by the loss of his or her chips;

awarding the pot to a single player if the resulting dice roll combination of indicia includes a single wild indicia uniquely referencing that player; and determining a winner by who is in possession of chips after each other player has been eliminated.

11. A method of playing a dice game by multiple players in accordance with claim 10, comprising the additional steps of:

predicting of a different outcome of the same dice roll combination of indicia by each other player, after the first player predicts the outcome of a dice roll combination of indicia;

awarding the chips anted into the pot to a player, if the resulting dice roll combination of indicia matches that player's prediction; and adding of additional chips to the pot and repeating of the prediction and rolling steps if the resulting dice roll combination of indicia does not match any of the player's predictions and cause the pot to be awarded to any player.

12. A method of playing a dice game by multiple players in accordance with claim 10, comprising the additional steps of:

providing each player with at least one predictive marker that selectively references the indicia included on the multiple dice;

using the predictive markers of each player to indicate his or her prediction of the outcome of the dice roll combination of indicia.

13. A dice game in accordance with claim 8, further comprising chips adapted to represent a player's bet, as recorded by the predictive markers.

14. A method of playing a dice game, comprising:

predicting the outcome of a dice roll combination with predictive markers bearing non-numerical indicia;

anteing at least one chip into a pot to enter a round of play;

rolling at least two dice that are imprinted with non-numerical indicia;

receiving the chips anted into the pot if the resulting dice roll combination of indicia matches the indicia on the predictive markers.

* * * * *